US010517366B2

(12) United States Patent
Baker

(10) Patent No.: US 10,517,366 B2
(45) Date of Patent: Dec. 31, 2019

(54) HAIR AND PILLOW PROTECTOR (HAPP)

(71) Applicant: Holli Colette Baker, Kapolei, HI (US)

(72) Inventor: Holli Colette Baker, Kapolei, HI (US)

( * ) Notice: Subject to any disclaimer, the term of this patent is extended or adjusted under 35 U.S.C. 154(b) by 119 days.

(21) Appl. No.: 15/673,426

(22) Filed: Aug. 10, 2017

(65) Prior Publication Data

US 2019/0045902 A1 Feb. 14, 2019

(51) Int. Cl.

| | |
|---|---|
| ***A45D 8/40*** | (2006.01) |
| ***A42C 5/00*** | (2006.01) |
| ***A42B 1/04*** | (2006.01) |

(52) U.S. Cl.

CPC ..... *A45D 8/40* (2013.01); *A42B 1/041* (2013.01); *A42C 5/00* (2013.01)

(58) Field of Classification Search

None

See application file for complete search history.

(56) References Cited

U.S. PATENT DOCUMENTS

| | | | | |
|---|---|---|---|---|
| 5,477,561 | A * | 12/1995 | Adkins | A42B 1/041 2/171.04 |
| 6,560,784 | B2 | 5/2003 | Hill | |
| 6,948,190 | B2 | 9/2005 | McGreggor | |
| 2002/0104150 | A1* | 8/2002 | Hill | A42B 1/041 2/174 |
| 2015/0047098 | A1* | 2/2015 | Pickett | A42B 1/18 2/183 |
| 2016/0198830 | A1* | 7/2016 | Tussey | A42B 1/041 2/183 |
| 2017/0112217 | A1* | 4/2017 | Diamond | A42B 1/041 |

* cited by examiner

*Primary Examiner* — Sarah B McPartlin

(57) ABSTRACT

A hair cover device and pillow protector to contain moisture and oils on the hair of a wearer's head. The Hair and Pillow Protector (HaPP), a multi-layer hair covering to protect hair from breakage, maintain moisture and oils applied to the hair while also preventing moisture, water and oils from saturating, damaging, staining or wetting a pillowcase, pillow, bed linens, seat headrest, etc. upon which a wearer rests a head. A fastening mechanism for adjustably securing the HaPP to the head of a wearer and an attachment mechanism on the hair covering in order to secure an additional head cover, such as a hat or wig, to the HaPP hair covering which allows the HaPP to be worn inside or outside during any general activity.

1 Claim, 4 Drawing Sheets

HAIR AND PILLOW PROTECTOR (HAPP)

CROSS REFERENCE TO RELATED APPLICATIONS

NOT APPLICABLE

STATEMENT REGARDING FEDERALLY SPONSORED RESEARCH OR DEVELOPMENT

NOT APPLICABLE

REFERENCE TO SEQUENCE LISTING

NOT APPLICABLE

BACKGROUND OF THE INVENTION

This disclosure relates to a hair cover device and related items and more particularly pertains to a new hair cover device for covering and protecting a person's hair during sleeping, napping or lounging and protecting objects in which the wearer might rest the head.

It is a further object of the present invention to provide a hair cover which may be produced in a variety of colors, prints, shapes and styles which will allow for a wide range of decorative outer surfaces and fashionable alternatives which can be worn inside or outside under various circumstances. It is a further object of the present invention to provide a hair cover which will offer an alternative to exposing hair to the harsh elements of the environment. It is a further object of the present invention to provide a hair cover which can be worn during normal daily activity with or without an attachment hair covering. It is a further object of the present invention to provide a hair cover which is comfortable, adaptable to a wearer's head in order to be sized and configured to adjust to any size head. It is a further object of the present invention to provide a hair cover which retains moisture to the hair. It is a further object of the present invention to provide a hair cover which prevents moisture and oils applied to the hair from saturating, damaging, staining or wetting a pillowcase, pillow, sheet or bed linens, flooring, seat headrest upon which a wearer might rest a head.

Additional objects, advantages, and features of the present invention will become apparent from the description to follow and the accompanying claims, when taken in conjunction with the drawings.

There are several types of coverings for protecting hair, many of which have been patented however none of the prior art hair coverings are designed to maintain moisture, water and/or oil within the hair covering, prevent objects such as pillow cases, bed linens, seat cushions, etc. from being saturated and/or stained and serve as a stylish accessory. Prior art hair coverings include: shower caps, sleeping caps, general caps, hats, bonnets, bands and wraps. An example of a hair covering is shown in the prior art illustrated in U.S. Patents.

U.S. Pat. No. 6,560,784 B2 issued to Jordan Heather Meredith Hill discloses a multi-layered moisture resistant hair wrap that surrounds a person's entire head to protect, maintain, and prolong a hairstyle and adapt to do so in moist environments that include water, steam, mist and humidity and absorbs moisture generated from heat or perspiration from one's scalp. The prior art does not solve the problem of retaining moisture in the hair or preventing water, moisture and oils applied to the hair from saturating, damaging, staining or wetting a pillowcase, pillow, sheet or bed linens, flooring, seat headrest upon which a wearer might rest a head.

U.S. Pat. No. 6,948,190 B2 issued to Carlin Denise McGregor discloses a head-hair cover for protecting a wearer's v-shaped hairdo while sleeping having two fabric chambers, one dome-shaped and the other v-shaped. The prior art does not solve the problem of preventing water, moisture and oils applied to the hair from saturating, damaging, staining or wetting a pillowcase, pillow, sheet or bed linens, flooring, seat headrest upon which a wearer might rest a head.

BRIEF SUMMARY OF THE INVENTION

The invention is designed to cover the head, and contain the user's hair, not only during periods of sleep but also during other various times throughout the day to maintain and/or moisturize the hair. It serves as protection to the hair or in such other applications as may be beneficial and protects objects in which the head might rest on or against. It has particular advantage when used by people having natural, oily or wet hair.

The HaPP is a hair covering designed to protect a user's hair and prevent the moisture and oils applied to the hair after washing or styling from saturating, damaging, staining or wetting objects or elements, such as a pillow case, bed linens, furniture, car seat head rests, etc., on which a person might rest their head. Staining to the objects causes irreversible damage and likely the object is eventually discarded, replaced and/or covered up to mask the stain. Many existing hair coverings are designed to protect and/or cover the hair only. The HaPP is multi-purpose in covering the hair and protecting objects upon which the hair might rest. The HaPP hair covering protects objects from the water and/or oils that are applied to the hair for hair care and/or maintenance.

The current invention addresses several issues relating to protecting a wearer's hair and objects that may come in contact with the hair. The HaPP hair covering helps to retain moisture in the hair while a user is wearing it and/or during an activity while simultaneously, the HaPP prevents bed linens, furniture and/or other objects from saturation from wet, and/or oily hair and from staining the object.

The HaPP solves the following problems:

1. Prevents Stains: Water and oils from hair stains pillowcases, bed linens, car seat head rests, furniture, etc.
2. Reduces Skin breakouts: Oil saturated pillowcases can cause skin disruptions.
3. Prevents and reduces Hair Breakage: Non-satin or non-silk materials can increase friction and cause hair breakage.

DETAILED DESCRIPTION OF THE INVENTION

Figure 1:
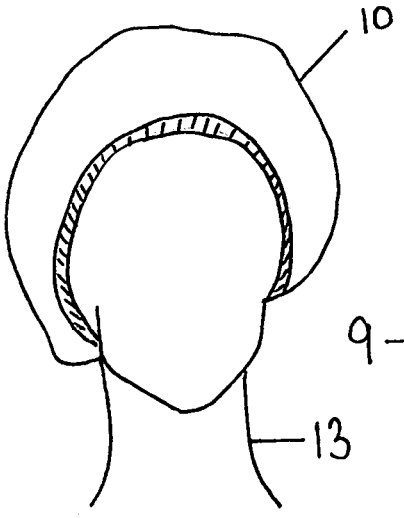
FIG. 1 is a partial front view of the present invention
Figure 1A:
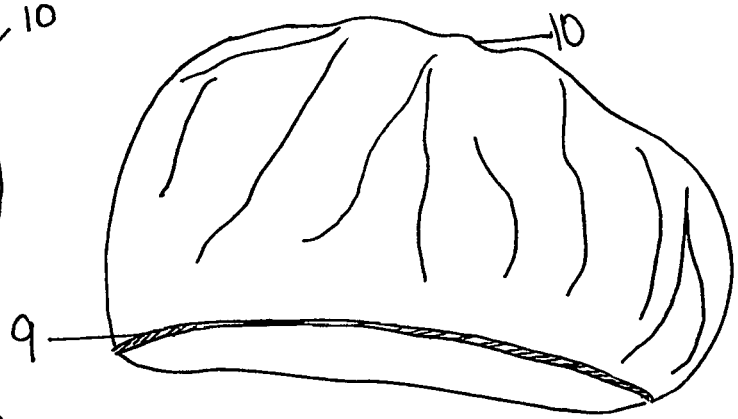
FIG. 1A is a close-up view of the present invention with fastening mechanism
Figure 2:
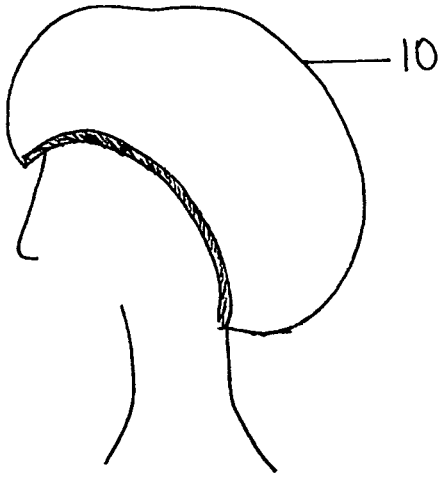
FIG. 2 is a side perspective of the present invention
Figure 3:
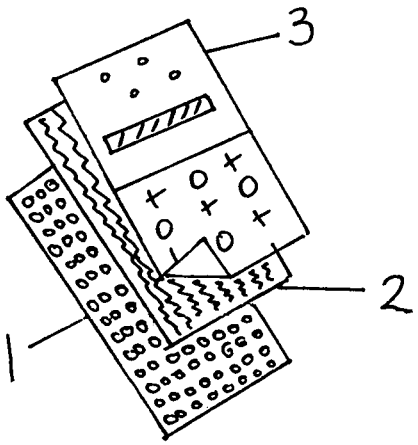
FIGS. 3, 3A, 3B, 3C is a view of fabric layers of the present invention
Figure 3A:
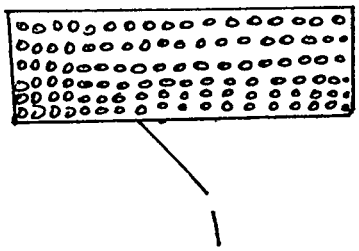
Figure 3B:
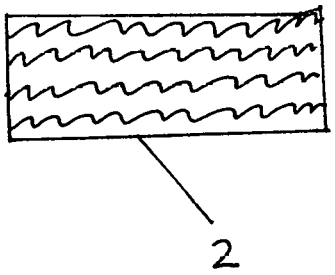
Figure 3C:
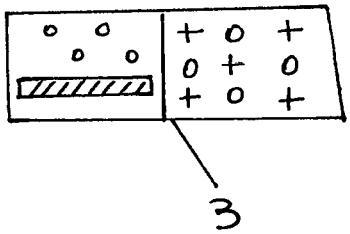
Figure 4:
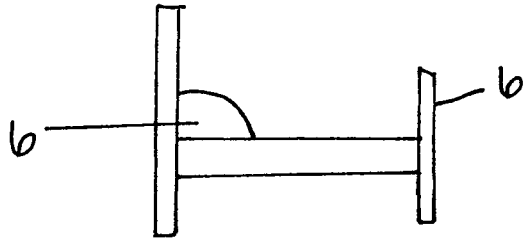
FIG. 4 is a side view of the present invention with hair covering and an object
Figure 4A:
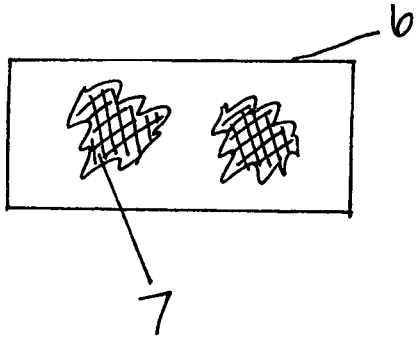
FIG. 4A is a view of the present invention with an object damaged by oil stains
Figure 5:
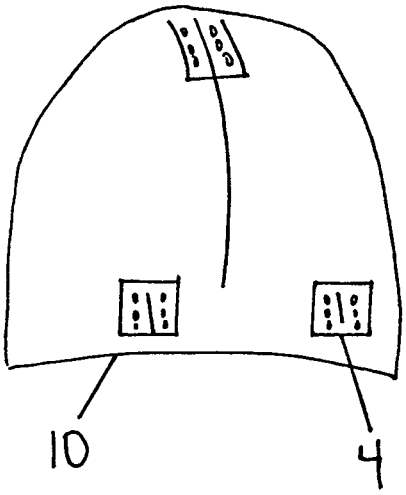
FIG. 5, 5A is a perspective view of the present invention with attachment hooks for a covering
Figure 5A:
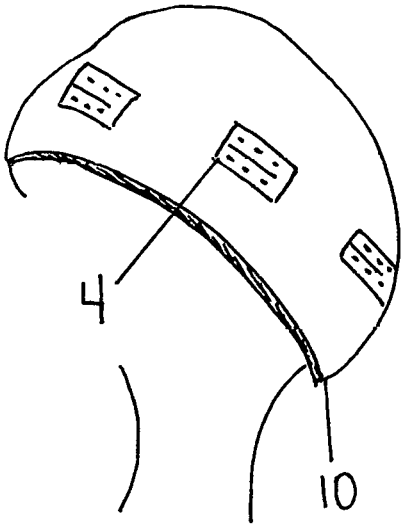
Figure 6:
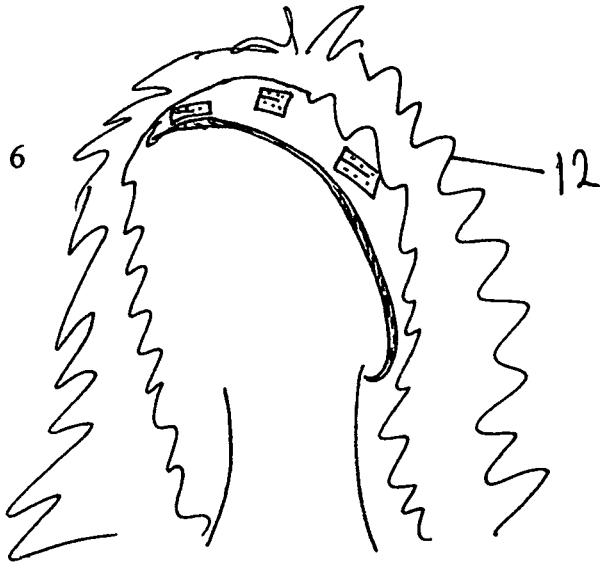
FIG. 6, 6A is a side perspective view of the present invention with an attachment hooks and additional hair covering.
Figure 6A:
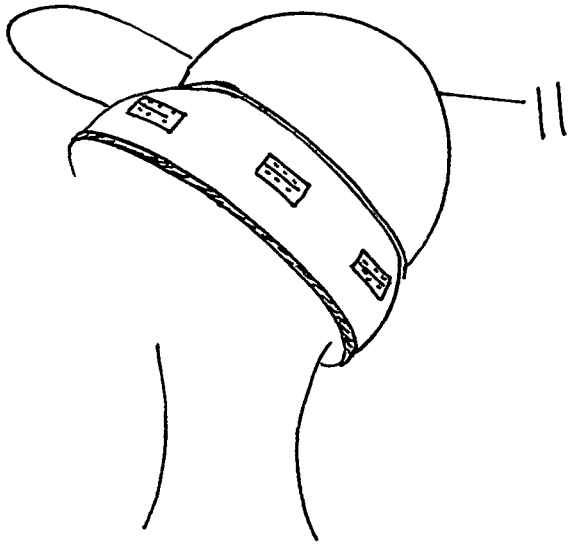

With reference to the drawings, there is shown various perspectives of a hair cover in accordance with the present invention. The HaPP is a multi-layered hair covering 10 sized and configured to protect the wearer's 13 hair and prevent the moisture and oils applied to the hair from staining 7, saturating, damaging, or wetting objects 6 or elements on which a person might rest their head.

The first layer 1 of the HaPP is the inner layer that has direct contact with the hair. The first layer has a first surface and a second surface and a peripheral edge. It is a layer essentially consisting of a smooth, lustrous natural material such as silk or can be a satin fabric Long, smooth filament fibers that have a "satin" weave are less absorbent than short-yarn fibers and cause less friction on the hair and tend to not drain away the hair's natural water content, or moisturizers that are used to keep hair hydrated.

The second layer 2 (or possibly the middle layer) of the HaPP essentially consists of a non-porous fabric material to help retain moisture in the hair and prevent water, oils and any other form of moisture penetration to the layer. The second layer has a first surface and a second surface and a peripheral edge. It is a water-resistant material to keep the hair moisture and oils from escaping the HAPP and saturating, transferring and penetrating objects on which the head/hair might rest.

The third layer 3 or (optional) outer layer essentially consists of a material which serves as a decorative outer cover. The outer cover can be of a stylish or decorative material or patterns to include multiple styles and designs. Either the second or third layer includes an optional attachment mechanism 4 such as hook and loop fasteners, snaps, buttons or the like to attach another form of hair covering to the hair cover such as a wig 12 or hat 11 which would allow the hair cover to be worn inside or outside and an adjustable fastening mechanism 9 such as a drawstring, elastic, tieback, or the like to adjustably secure the hair cover to the wearer's head. These layers are attached together to form a bonnet, hat, scarf or other form of hair covering to be worn on the head to cover the wearer's hair.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure. Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent application, a reference to an element by the indefinite article "a" does not exclude the possibility that more than one of the element is present, unless the context clearly requires that there be only one of the elements.

The invention claimed is:

1. A multi-layer fabric hair covering for covering a head of a user to contain natural, oily or wet hair, said multi-layer fabric covering for retaining moisture in the hair, for protecting the hair and for simultaneously protecting objects directly contacted by the hair from damaging stains, the multi-layer fabric hair covering consisting essentially of:

a first inner layer, a second middle layer and a third outer layer configured for encircling and encapsulating the user's hair and defining a domed interior cavity for receiving the users head;

the first inner layer having an upper surface, a lower surface, a peripheral edge and a circumference sized and configured for said lower surface to directly contact the hair of the user, said first inner layer consisting of a material selected from a group of silk, satin or other natural pliant fabrics with long filament fibers, wherein the material is less absorbent than a short-yarn fiber material and inhibits oils and water on the hair of the user from draining away from the hair;

the second middle layer having an upper surface, a lower surface, peripheral edge and a circumference, said second middle layer consisting of a water-resistant material acting as a barrier layer and made from a non-porous fabric which prevents water, oils and other forms of moisture from penetrating the second middle layer and therefore prevents wetting, water saturation and moisture transfer to objects directly contacted by the user's head;

the third outer layer having an upper surface, a lower surface, a peripheral edge and a circumference and consisting of a material having a decorative patterned surface on said upper surface;

wherein the first inner layer upper surface is directly attached to the second middle layer lower surface, the third outer layer lower surface is directly attached to said second middle layer upper surface to form a bonnet, hat, scarf or other form of hair covering;

a fastening mechanism surrounds the perimeters of the first inner layer, the second middle layer and the third outer layer, and is configured for adjustably securing the multi-layered covering to the user's head; the fastening mechanism is selected from the group consisting of a drawstring, elastic or tiebacks;

an attachment mechanism selected from the group consisting of hook and loop fasteners, snaps or buttons, wherein the attachment mechanism is configured for attaching said multi-layered covering to a wig, hat or other head covering;

wherein when oils, water or other forms of moisture are applied to the hair, said multi-layered hair covering protects the user's hair from breakage and retains moisture, water and oil on the hair while preventing the moisture, water and oil from penetrating the layers and saturating, damaging, staining or wetting objects on which the user directly places their head.

* * * * *